United States Patent [19]

Johnston

[11] 3,955,505

[45] May 11, 1976

[54] DETONATING APPARATUS

[75] Inventor: Lawrence H. Johnston, Minneapolis, Minn.

[73] Assignee: The United States of America as represented by the United States Energy Research and Development Administration, Washington, D.C.

[22] Filed: May 31, 1950

[21] Appl. No.: 165,171

[52] U.S. Cl. ..... 102/28 R

[51] Int. Cl.[2] ..... F42B 3/14

[58] Field of Search ..... 102/28, 28 X, 28 S, 102/27 C; 52/2, 2.1

[56] References Cited

UNITED STATES PATENTS

| | | | |
|---|---|---|---|
| 97,241 | 11/1869 | Smith | 102/28 |
| 319,628 | 6/1885 | Russell | 102/46 |
| 347,013 | 8/1886 | Scola | 102/28 |
| 2,404,553 | 7/1946 | Waks, Jr. | 102/70.2 |

*Primary Examiner*—Verlin R. Pendegrass
*Attorney, Agent, or Firm*—Dean E. Carlson; Paul D. Gaetjens

EXEMPLARY CLAIM

1. Apparatus for detonation of high explosive in uniform timing comprising in combination, an outer case, spark gap electrodes insulatedly supported in spaced relationship within said case to form a spark gap, high explosive of the class consisting of pentaerythritol tetranitrate and trimethylene trinitramine substantially free from material sensitive to detonation by impact compressed in surrounding relation to said electrodes including said spark gap under a pressure from about 100 psi to about 500 psi, said spark gap with said compressed explosive therein requiring at least 1000 volts for sparking, and means for impressing at least 1000 volts on said spark gap.

4 Claims, 2 Drawing Figures

WITNESSES:

Ralph Carlos Smith

Kenneth F. Ross

INVENTOR:

Lawrence H. Johnston

BY

Roland A. Anderson

Attorney

WITNESSES:

Ralph Carlos Smith

Kenneth F. Ross

INVENTOR:

Lawrence H. Johnston

BY

Roland A. Anderson

Attorney

DETONATING APPARATUS

This invention relates to electric detonators and more particularly to electric detonators of the spark gap type.

The detonators known in the explosives art have consistently employed a charge of a primary explosive such as mercury fulminate or lead azide to transform the mechanical or heat energy of the firing system into a detonation wave which could set off the main charge of high explosive, suitably with the aid of a booster charge of other high explosive somewhat more sensitive to detonation by shock than would be desirable in a large main charge. In particular, electric detonators have initiated explosion of primary explosives by heat generated either by passing a spark across a gap, or by ohmic heating of resistance wire. Examples of devices using primary explosives are the detonators of the copending joint application of the Applicant and Robert Alldredge, Ser. No. 183,586 filed Sept. 7, 1950, and now U.S. Pat. No. 3,361,064, and of the prior art, for example, as disclosed in U.S. Pat. No. 2,360,698, to Lyte, which shows a mixture containing a primary explosive adapted to be set off by heat from a bridge wire or matchhead.

Electric detonators of the prior art are subject to a number of disadvantages. Bridge wire type detonators which use primary explosives may often be detonated by accidental application of ordinary low voltages, such as those from storage batteries and the usual utility circuits, inasmuch as application of even such low voltages can frequently raise the bridge wire to a temperature which sets off the surrounding explosive even though the bridge wire itself is not ignited. Largely because of this danger spark gap detonators requiring relatively high voltages for sparking the gap appear to be preferable to the bridge wire type for most purposes.

A further disadvantage of detonators using primary explosive lies in the fact that the primary explosives are highly sensitive to detonation by impact. This may be due to heat generated by friction between the loose particles. A more series disadvantage peculiar to detonators using loose primary explosives is that they are subject to a non-uniform time lag between the application of current and detonation of the explosive. This lag results largely from the non-uniform density of the loose charge of primary explosive and, in addition, in the bridge wire detonator, from the time required to heat the bridge wire to the point where the explosive detonates. This disadvantage is a highly important factor in many commercial operations where simultaneity of a number of detonations is required. Finally, it has been found that spark gap detonators utilizing a loosely packed primary explosive may require a relatively large amount of electrical energy to produce a spark of sufficient intensity to detonate the explosive because of the inefficiency of the spark gap.

It is therefore an object of this invention to provide an improved detonator.

It is another object of this invention to provide a detonator in which the time lag is uniform and is reduced to a minimum.

It is still another object of this invention to provide a detonator which is highly insensitive to detonation by shock and by the application of ordinary low voltages.

It is a further object of this invention to provide a detonator which can be detonated by a minimum amount of electrical energy.

It has been found that the above and other objects can be accomplished and difficulties including those enumerated can be overcome by a detonating apparatus comprising a container, spark gap electrodes maintained in spaced relationship within said container to form a spark gap, a non-primary high explosive compacted in the spark gap under a pressure not in excess of 500 psi and means for firing the spark gap. This invention is to be distinguished from that disclosed in Applicant's copending Application Ser. No. 562,517 filed Nov. 8, 1944, and now U.S. Pat. No. 3,040,660, which discloses the use of non-primary explosive in contact with an exploding bridge wire in a detonator.

The invention can best be understood by reference to the accompanying drawings hereby made a part of this specification.

Figure 1:
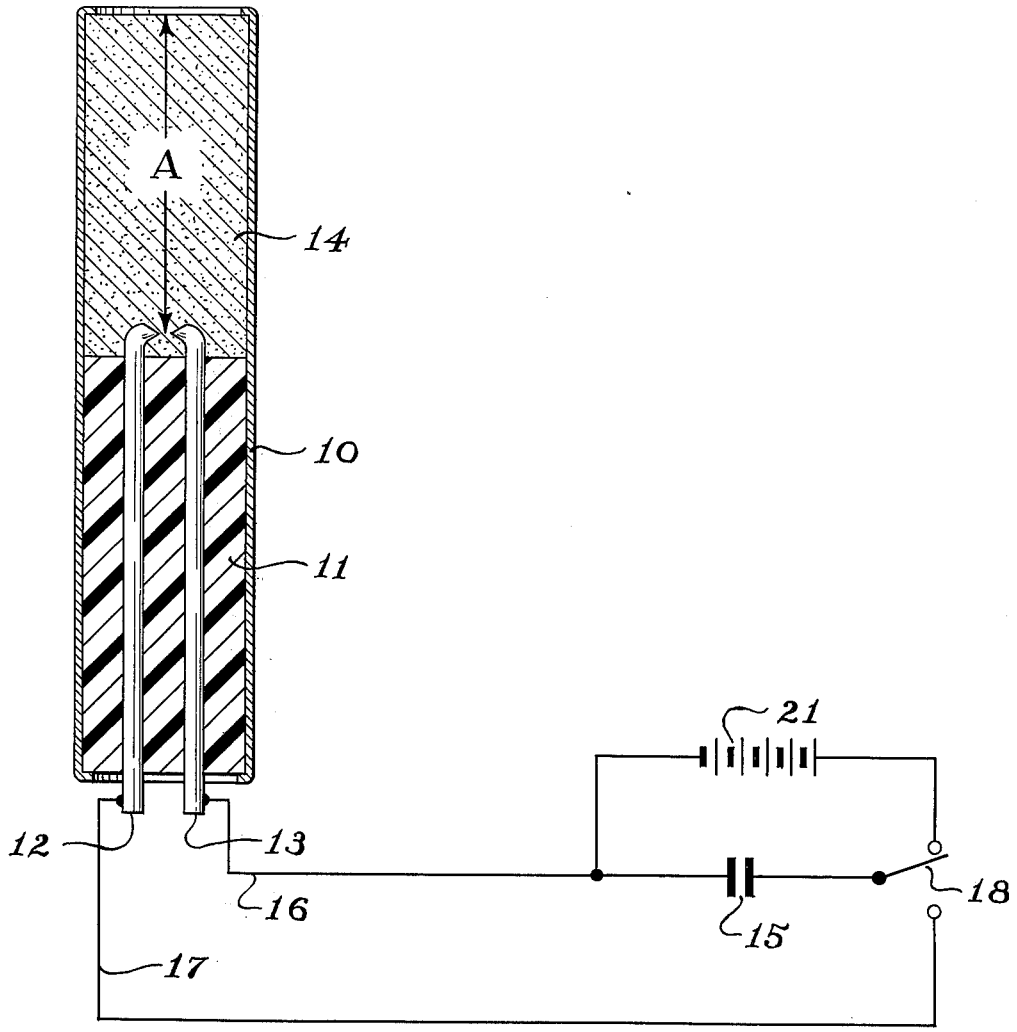
FIG. 1 is an illustration of the apparatus of the invention with the detonator shown in section.

Referring particularly to FIG. 1, the detonating apparatus comprises a case 10 which is preferably of tubular form of metal or other suitable material. At 11 is shown a supporting plug of plastic or other dielectric material which seals the lower end of container 10. The plug 11 supports the electrodes 12 and 13 in spaced relationship, their upper ends extending through the upper end of the plug to form a spark gap and their lower ends extending through the lower end of the plug for electrical connection. A charge of non-primary high explosive 14 is pressed into the space directly above the plug 11 and in the spark gap formed by the upper ends of electrodes 12 and 13. A circuit for sparking the gap comprises a condenser 15 connected to lead-in wires 16 and 17 through a switch 18, which in one position connects the condenser to a source of high voltage such as a battery 21 and in the other position discharges the condenser 15 across the spark gap formed by electrodes 12 and 13.

The explosive used is a non-primary high explosive of the type ordinarily used for the main charge in blasting operations as distinguished from sensitive, readily detonated explosives of the primary type such as lead azide and mercury fulminate. Examples of explosives which are suitable for use in the detonator of this invention are PETN (pentaerythritol tetranitrate) and RDX (trimetylenetrinitramine), although the explosives which may be used are by no means restricted to these examples. These explosives are quite insensitive to detonation by shock and detonators employing them can be handled without the usual precautions required in handling conventional detonators using primary type explosives.

An essential feature of the invention and one which makes possible the novel use of a non-primary high explosive in the spark gap of a detonator results from the discovery that if the explosive is compressed under a pressure of from about 100 to 500 psi but not in excess of about 500 psi, the efficiency of the spark gap is increased without appreciably increasing the energy input required for detonation. This is contrary to what would ordinarily be expected as the sensitivity of explosives usually decreases with increased compression.

However, this unexpected result is believed to be due to the fact that the impedance of the gap is probably increased by the effects of applying the correct amount of pressure to the explosive, thus making the gap more efficient for utilizing electrical energy. It has been found that the pressure used should not be substantially in excess of 500 psi for PETN and RDX since above this point the sensitivity of the materials to electrical energy drops off very rapidly and the sparking potential required for detonation rises rapidly.

Figure 2:
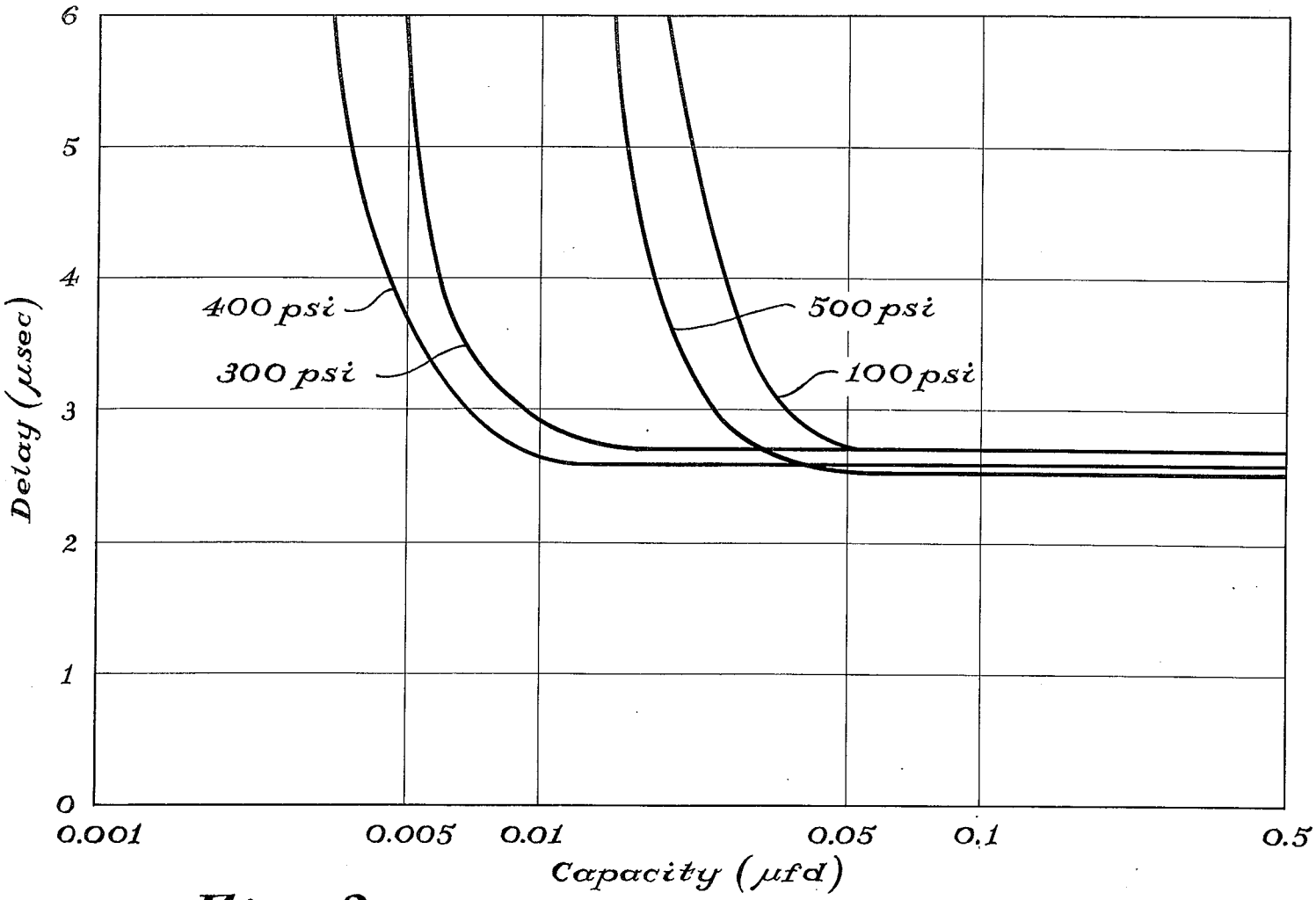
FIG. 2 is a family of curves showing firing delay versus firing energy for various pressures used to compress PETN (pentaerythritol tetranitrate) in the spark gap of the detonator of this invention.

The effect of the pressure used to compact the high explosive is graphically illustrated by the curves of FIG. 2 in which time delay is plotted against firing energy for various pressures. It will be noted that for a given time delay such as 3 microseconds the energy required for successful firing of the device decreases as the pressure is increased from 100 to 400 psi. It will be further noted that when the pressure is increased to 500 psi a marked increase in firing energy is required and that the smallest time delay is reached. This range of pressure, that is, 100–500 psi, is critical for the purposes of this invention as pressures above 500 psi increase the energy requirement to a point where an impractically large amount of electrical energy is required.

The beneficial effects of compressing the high explosive are not limited to increasing the efficiency of the spark mechanism. It has been found that the use of the proper amount of pressure increases the detonation velocity and brisance of the explosive charge. Further, the resistance of the explosive to detonation by shock is appreciably increased by compressing it. In addition, the use of a uniformly compacted explosive in the spark gap results in a uniform time lag so that reproducibility of timing can be effected, thus permitting simultaneity of explosion among a number of detonators. Finally, the use of compressed high explosive in the spark gap reduces the time lag itself to a minimum.

To insure further uniformity of timing among a number of detonators it is important that identical amounts of explosive be compressed in each detonator not only under equal pressures but to substantially identical dimensions. This procedure insures that the distance A as shown in FIG. 1 between the plane in which the spark travels across the gap and the upper face of the primary explosive is substantially the same for all detonators of a group. Detonators of the prior art are highly deficient in this respect. This lack is probably due in part to the fact that prior to this time there has been very little demand for a detonator having a delay in microseconds or for simultaneity within fractions of microseconds among a number of detonators and consequently previous methods of manufacture are not capable of providing such a detonator. This is especially true with respect to the method of loading prior art detonators which is necessitated by the construction of the detonators.

Detonators of the prior art such as those disclosed in U.S. Pat. No. 2,360,698 to Lyte employing electrodes made integral with a removable plug require that the electrodes be placed in position after the explosives have been inserted. This makes it impossible to apply pressures to the explosive surrounding the spark gap so that, as a result, prior art detonators have not had a uniform time lag or a time lag in microseconds. Conversely, in manufacturing the detonator of this invention the electrodes are secured in one end of the outer case first and the explosives loaded from the open end. By using this novel procedure, accurately controlled pressures can be applied to the explosive during loading so that accurately controlled dimensions can be achieved. This permits manufacture of detonators containing substantially identical amounts of explosive compressed under substantially identical pressures, thereby contributing materially to the attainment of uniformity in time lag among detonators.

The electrodes used may be of copper, aluminum or like material. A spark gap varying in width from 0.015 to 0.025 inches has been found suitable from a practical standpoint. Although a spark gap arrangement of two electrodes as disclosed is the preferred embodiment other arrangements may be used. For example, a spark gap in which the detonator case serves as one electrode may be used or more than two electrodes may be used if desired. The electrical energy necessary to bridge the gap may be furnished by a condenser of 0.1 microfarad capacity charged to about 5600 volts. In the interests of safety the characteristics of the gap with the pressed explosive therein should be such that at least 1000 volts are required to spark the gap. For simultaneous explosions a capacity of 0.06 mfd per detonator has been found satisfactory; however, good simultaneity has been obtained with capacities as low as 0.01 mfd or lower.

It is an advantage of the invention that it provides a detonator having a uniform time delay thus making reproducibility of timing possible and therefore permitting simultaneity among a number of explosions. Spreads as low as tenths of microseconds among a number of detonations have been consistently obtained in tests in which they were used.

It is another advantage of the invention that it provides a detonator which is highly resistant to detonation by impact and which is not detonated by ordinary low voltges. A further advantage is the fact that the detonator may be detonated by relatively small amounts of electrical energy.

As many apparently widely different embodiments of this invention may be made without departing from the spirit and scope thereof, it is to be understood that the invention is not limited to the specific embodiments thereof except as defined in the appended claims.

What is claimed is:

1. Apparatus for detonation of high explosive in uniform timing comprising in combination, an outer case, spark gap electrodes insulatedly supported in spaced relationship within said case to form a spark gap, high explosive of the class consisting of pentaerythritol tetranitrate and trimethylene trinitramine substantially free from material sensitive to detonation by impact compressed in surrounding relation to said electrodes including said spark gap under a pressure from about 100 psi to about 500 psi, said spark gap with said compressed explosive therein requiring at least 1000 volts for sparking, and means for impressing at least 1000 volts on said spark gap.

2. Apparatus for the detonation of insensitive high explosive in uniform timing comprising, in combination, an outer case, spark gap electrodes insulatedly supported in spaced relationship within said case to form a spark gap, an insensitive high explosive of the class consisting of pentaerythritol tetranitrate and trimethylene trinitramine substantially free from material sensitive to detonation by impact compressed in surrounding relation to said electrodes including said spark gap under a pressure of about 400 pounds per square inch, said spark gap with said compressed explosive therein requiring at least 1000 volts for sparking, and means for impressing at least 1000 volts on said spark gap.

3. The apparatus of claim 2 in which the explosive is pentaerythritol tetranitrate.

4. The apparatus of claim 2 in which the explosive is trimethylene trinitramine.

* * * * *